US006354105B1

(12) United States Patent
Lee et al.

(10) Patent No.: US 6,354,105 B1
(45) Date of Patent: Mar. 12, 2002

(54) SPLIT FEED COMPRESSION PROCESS FOR HIGH RECOVERY OF ETHANE AND HEAVIER COMPONENTS

(75) Inventors: Rong-Jwyn Lee, Sugar Land; Pallav Jain, Houston; Jame Yao; Jong Juh Chen, both of Sugar Land; Douglas G. Elliot, Houston, all of TX (US)

(73) Assignee: IPSI L.L.C., Houston, TX (US)

( * ) Notice: Subject to any disclaimer, the term of this patent is extended or adjusted under 35 U.S.C. 154(b) by 0 days.

(21) Appl. No.: 09/596,398

(22) Filed: Jun. 16, 2000

Related U.S. Application Data

(60) Provisional application No. 60/168,981, filed on Dec. 3, 1999.

(51) Int. Cl.[7] ..... F25J 3/00
(52) U.S. Cl. ..... 62/619; 62/647
(58) Field of Search ..... 62/619, 620, 647

(56) References Cited

U.S. PATENT DOCUMENTS

| | | | | |
|---|---|---|---|---|
| 4,140,504 A | | 2/1979 | Campbell et al. | |
| 4,157,904 A | | 6/1979 | Campbell et al. | |
| 4,251,249 A | | 2/1981 | Gulsby | |
| 4,278,457 A | | 7/1981 | Campbell et al. | |
| 4,453,958 A | | 6/1984 | Gulsby et al. | |
| 4,519,824 A | | 5/1985 | Huebel | |
| 4,617,039 A | | 10/1986 | Buck | |
| 4,687,499 A | | 8/1987 | Aghili | |
| 4,695,303 A | | 9/1987 | Montgomery, IV, et al. | |
| 4,698,081 A | | 10/1987 | Aghili | |
| 4,752,312 A | | 6/1988 | Prible | |
| 4,843,828 A | * | 7/1989 | Gladman | 62/647 |
| 4,851,020 A | | 7/1989 | Montgomery, IV | |
| 4,854,955 A | | 8/1989 | Campbell et al. | |
| 4,869,740 A | | 9/1989 | Campbell et al. | |
| 4,889,545 A | | 12/1989 | Campbell et al. | |
| 5,275,005 A | | 1/1994 | Campbell et al. | |
| 5,325,673 A | | 7/1994 | Durr et al. | |
| 5,555,748 A | | 9/1996 | Campbell et al. | |
| 5,566,554 A | | 10/1996 | Vijayaraghavan et al. | |
| 5,568,737 A | | 10/1996 | Campbell et al. | |
| 5,685,170 A | | 11/1997 | Sorensen | |
| 5,890,377 A | | 4/1999 | Foglietta | |
| 5,890,378 A | | 4/1999 | Rambo et al. | |
| 5,953,935 A | | 9/1999 | Sorensen | |
| 6,062,044 A | * | 5/2000 | Bernard et al. | 62/654 |

* cited by examiner

*Primary Examiner*—William C. Doerrler
(74) *Attorney, Agent, or Firm*—Madan, Mossman & Sriram, P.C.

(57) ABSTRACT

A process for enhancing recovery of ethylene, ethane and heavier components using a cryogenic distillation column which involves dividing the feed gas into a first gaseous stream and a main gaseous stream. The first gaseous stream is compressed and cooled, and then expanded and introduced into the cryogenic distillation column as main reflux stream, or is further processed to generate at least one reflux stream to the cryogenic distillation column.

18 Claims, 5 Drawing Sheets

(Comparative)

SPLIT FEED COMPRESSION PROCESS FOR HIGH RECOVERY OF ETHANE AND HEAVIER COMPONENTS

This application claims the benefit of U.S. Provisional Application No. 60/168,981 filed Dec. 3, 1999.

FIELD OF THE INVENTION

The present invention relates to systems and methods for recovering ethylene, ethane, and heavier hydrocarbons from natural gases and other gases, e.g. refinery gases, and in a further embodiment relates to methods and structures for recovering ethylene, ethane, and heavier hydrocarbon components from natural gases and other gases using a cryogenic expansion process with a relatively low expansion ratio across the expander.

BACKGROUND OF THE INVENTION

Cryogenic expansion processes have been well recognized and employed on a large scale for hydrocarbon liquids recovery since the turbo-expander was first introduced to gas processing in the late 1960s. It has become the preferred process for high ethane recovery with or without the aid of external refrigeration depending upon the composition (richness) of the gas. In a conventional turbo-expander process, the feed gas at elevated pressure is pre-cooled and partially condensed by heat exchange with other process streams and/or external propane refrigeration. The condensed liquid with less volatile components is then separated and fed to a fractionation column (e.g., a demethanizer), operated at medium or low pressure, to recover the heavy hydrocarbon constituents desired. The remaining non-condensed vapor portion is subjected to turbo-expansion to a lower pressure, resulting in further cooling and additional liquid condensation. With the expander discharge pressure typically the same as the demethanizer pressure, the resultant two-phase stream is fed to the top section of the demethanizer with the cold liquids acting as the top reflux to enhance recovery of heavier hydrocarbon components. The remaining vapor combines with the column overhead as a residue gas, which is then recompressed to pipeline pressure after being heated to recover available refrigeration.

Because the demethanizer operated as described above acts mainly as a stripping column, the expander discharge vapor leaving the column overhead that is not subject to rectification still contains a significant amount of heavy components. These components could be further recovered if they were brought to a lower temperature, or subject to a rectification step. The lower temperature option can be achieved by a higher expansion ratio and/or a lower column pressure, but the compression horsepower would have to be too high to be economical. Ongoing efforts attempting to achieve a higher liquid recovery have mostly concentrated on the addition of a rectification section and how to effectively increase or provide a colder and leaner reflux stream to the expanded vapor. Many patents exist pertaining to a better and improved design for separating ethane and heavier components from a hydrocarbon-containing feed gas stream.

U.S. Pat. No. 4,140,504 describes methods to improve liquid recovery in a typical cryogenic expansion process by adding a rectification section to the expander discharge vapor, and using the partially condensed liquid as the reflux after it is further cooled and expanded to the top of the rectification section. U.S. Pat. No. 4,251,249 adds a separator at expander discharge, separates liquid from the expanded two phase stream, and sends the liquid to column for further processing. The separated vapor provides refrigeration in a reflux condenser to minimize the loss of heavy components in the overhead vapor stream. In yet another approach, e.g. U.S. Pat. No. 5,566,554, the partially condensed liquid is preheated and expanded to a second separator at an intermediate pressure to yield a vapor stream preferably comprising lighter hydrocarbon components. This leaner stream returns to the demethanizer top as an enhanced reflux after being condensed again and subcooled. The reflux stream so generated is rather limited, and the heavy components not recovered are still substantial.

The most recognized approach for high ethane recovery, perhaps, is the split-vapor process as disclosed in U.S. Pat. Nos. 4,157,904 and 4,278,457. In these patents, the non-condensed vapor is split into two portions with the majority one, typically about 65%–70%, passing through a turbo-expander as usual, while the remaining portion being substantially subcooled and introduced to the demethanizer near the top. This higher and colder reflux flow permits an improved ethane recovery at a higher column pressure, thereby reducing recompression horsepower requirements, in spite of less flow being expanded via the turbo-expander. It also provides an advantage in reducing the risk of $CO_2$ freezing in the demethanizer. The achievable recovery level in these processes, however, is ultimately limited by the composition of the vapor stream used for the top reflux due to equilibrium constraints. Ethane recovery up to 90% is achievable when the expansion ratio is high, typically in excess of 2.5.

The use of a leaner reflux is an attempt to overcome the aforementioned deficiency. One approach is to cool the split vapor stream half way through and expand it to an intermediate pressure, causing partial condensation. The condensed liquid comprising less volatile components is separated in a separator and fed to the demethanizer above the feed from the turbo-expander discharge as the mid-reflux. The leaner vapor so generated is further cooled to substantial condensation and used as top reflux. U.S. Pat. No. 4,519,824 is a typical example. U.S. Pat. No. 5,555,748 further improves this process by cooling the separated liquid prior to entering the demethanizer as the mid-reflux.

A substantially ethane-free reflux has been introduced in some processes, which permits essentially total recovery of ethane and heavier components from a hydrocarbon containing feed stream. These processes recycle a portion of the residue gas stream as the top reflux after being condensed and deeply subcooled. Because the residue gas contains the least amount of ethane in the entire process, ethane recovery in excess of 98% is achievable by providing more and leaner reflux from recycle of a significant amount of residue gas. It should be noted that it is the liquid reflux in contact with, providing refrigeration to, and promoting condensation of the uprising heavy component vapor to enhance liquid recovery. Therefore, the recycle of residue gas must be recompressed to a much higher pressure with penalty on compression horsepower to enable its total condensation.

U.S. Pat. Nos. 4,851,020 and 4,889,545 utilize the cold residue gas from the demethanizer overhead as the recycle stream. This process requires a compressor operating at a cryogenic temperature. Warm residue gas taken from the residue gas compressor, eliminating the need of a dedicated compressor, is disclosed in U.S. Pat. Nos. 4,687,499 and 5,568,737. An alternate arrangement with a recycle compressor which is required for a low residue gas pressure scenario and/or permits optimal pressure of recycle residue gas is also presented in U.S. Pat. No. 5,568,737.

To enhance ethane and NGL recovery efficiency, the aforementioned prior arts typically involve generating a colder and leaner reflux stream for the top rectification section of the demethanizer and requiring the turbo expander to operate at a high expansion ratio. In the case of a low feed gas pressure, the pressure of the feed gas has to be raised so that a portion of the gas can be liquefied and fed to the demethanizer as a reflux via the use of cold residue gas as a typical cooling medium. Raising the inlet gas pressure also permits a high expansion ratio across the expander. This option leads to a higher horsepower requirement for the front end compression. Alternately, the demethanizer can be operated at a reduced pressure. However, it leads to a higher recompression horsepower or a possibility of $CO_2$ freezing when the feed gas contains a sufficient amount of $CO_2$. In both cases, compression power has been applied to the total flow either at the front-end (i.e. feed gas) or the back-end (i.e. residue gas) to promote partial condensation of feed gas as a demethanizer reflux and to gain the expander refrigeration, which is generally not the most efficient approach in most cases. In some cases, the equipment for the inlet gas cooling is not designed with a high enough design pressure for a retrofit to an existing facility.

SUMMARY OF THE INVENTION

Accordingly, it is an object of the present invention to provide a process for separating components of a feed gas containing methane and heavier hydrocarbons which maximizes ethane recovery but does not require appreciable increases in capital and operating costs.

In carrying out these and other objects of the invention, there is provided, in the broadest sense, a process for cryogenically recovering components of hydrocarbon-containing feed gas in a distillation column, e.g. a cryogenic distillation column such as a demethanizer, in which the main reflux to the demethanizer is provided by compressing and condensing only a slip stream of the feed gas. A reflux compressor compresses the slipstream of the feed gas to a pressure suitable for condensation. Thus the compression power is utilized in the areas where it is needed the most, namely the reflux streams for the demethanizer. Thus, this method avoids unnecessary compression of the whole feed gas stream, and hence avoids waste of horsepower (due to inefficiencies in the compression and expansion process). Shortage in the refrigeration, if any, can be effectively supplemented by either the enhanced stripping gas scheme incorporated with this invention, or the external refrigeration.

In one form of the present invention, the feed gas is split into two streams. The smaller slip stream that has to be used as a reflux, typically ranging from 20% to 40% of total feed gas flow, is compressed by the reflux compressor and is cooled and fed to a cold separator. The use of a cold separator is only optional and is typically recommended when the feed gas contains heavier constituents, such as aromatic compounds, which could potentially freeze up at cryogenic temperatures. The main portion of feed gas is cooled to partial condensation in the inlet heat exchangers and fed to the expander inlet separator for separating condensed liquid components. The separated liquid portion is expanded and fed to the demethanizer. The vapor portion from the expander inlet separator is typically expanded via a work-generating expander and then fed to the demethanizer. In this embodiment the need for refrigeration, if any, to cool the inlet gas is provided by either the enhanced stripping gas scheme or by external refrigeration.

In another form of the methods of the present invention, supplemental refrigeration needed for the inlet gas cooling, if any, is provided by external refrigeration, such as propane.

In yet another form of the methods of the present invention, the inlet feed gas is cooled and partially condensed in the inlet heat exchangers. The partially condensed gas is separated in an expander inlet separator. A slipstream of the vapor portion from the expander inlet separator is compressed, condensed and used as a main reflux in the demethanizer. Thus as compared to the above embodiment, in this scheme the reflux compressor compresses the vapors from the expander inlet separator instead of the feed gas. Since the vapor from the expander inlet separator will be leaner than the inlet feed gas there might be additional advantages associated with this scheme.

BRIEF DESCRIPTION OF THE DRAWINGS

The application and advantages of the invention will become more apparent by referring to the following detailed description in connection with the accompanying drawings, wherein.

It will be appreciated that FIGS. 1–5 are not to scale or proportion, as they are simply schematics for illustration purposes.

DETAILED DESCRIPTION OF THE INVENTION

For purposes of comparison only, an exemplary prior process will be described with reference to FIG. 1 and compared with the inventive process. The methods of the present invention will be described with reference to FIGS. 2, 3, 4, and 5. Various values of temperature, pressure, and flow rate are recited in association with the specific examples described below; those conditions are approximate and merely illustrative, and are not meant to limit the invention. In one non-limiting embodiment of the invention, where ethane and heavier (C2+) components are desired to be recovered from a feed gas, at least about 90% of the C2+ hydrocarbons in said feed gas are recovered in said natural gas liquid product.

Figure 1:
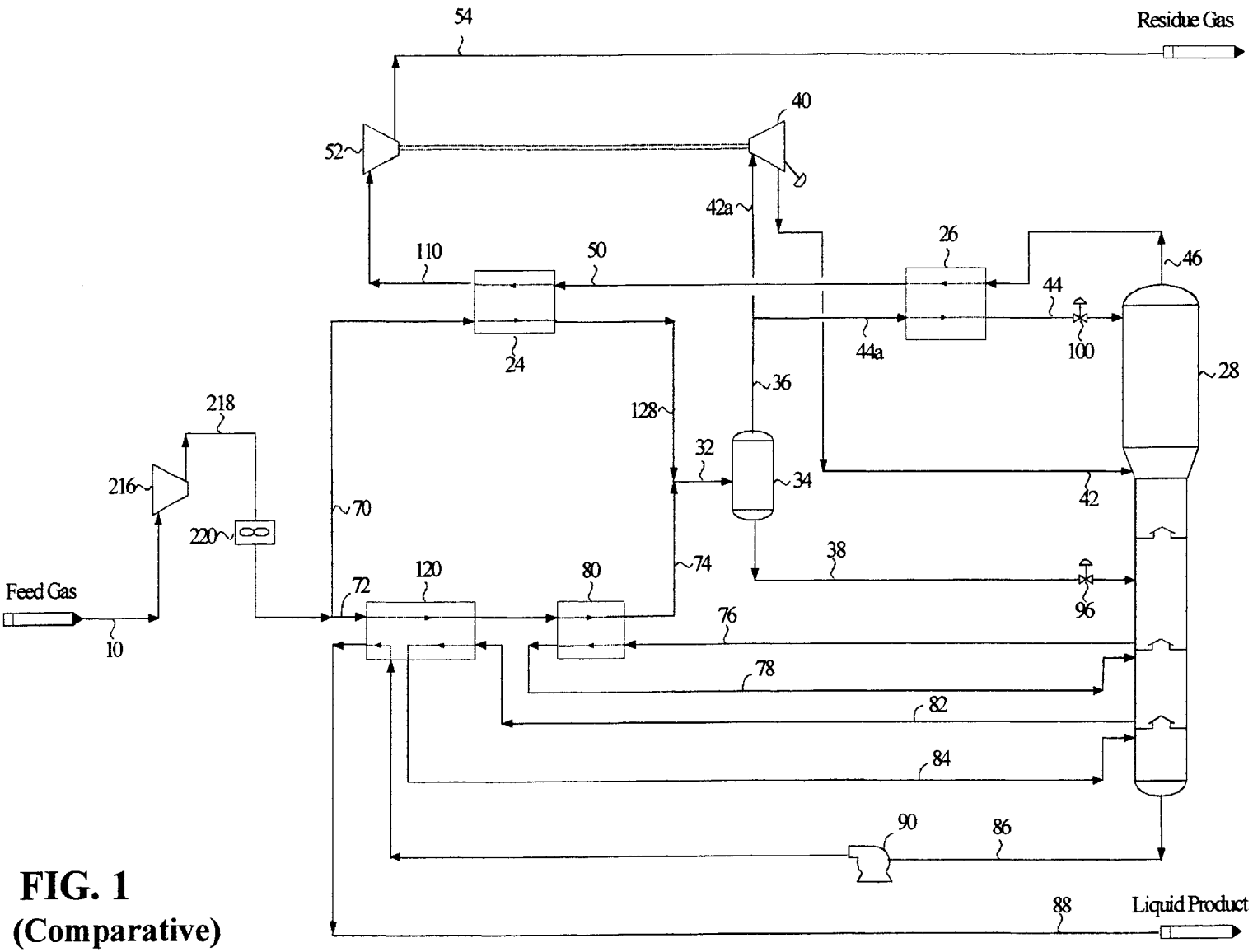
FIG. 1 is a schematic representation of a comparative cryogenic expansion process.

Referring to FIG. 1, a feed gas comprising a pretreated and clean natural gas or refinery gas stream is introduced into the illustrated process through inlet stream 10 at the ambient temperature and a pressure of about 600 psia. The pretreatment typically involves removal of any concentration of sulfur compounds, mercury, and water as necessary. Feed stream 10 is first compressed to approximately 770 psia via feed gas compressor 216. The compressed feed gas 218 is then cooled to approximately 110° F. in cooler 220 prior to being splitting into streams 70 and 72. Stream 70 is further cooled in gas/gas exchanger 24. On the other hand, stream 72 is cooled in gas/liquid exchanger 120 and side reboiler 80. Cooled stream 128 from exchanger 24 is combined with the other cooled stream 74 from exchanger 80. The combined stream 32 at approximately −50° F. is introduced into the expander inlet separator 34 for separation of condensed liquid, if any, as stream 38. The liquid portion as stream 38 is delivered to the middle of demethanizer 28, after being flashed to the demethanizer pressure in expansion valve 96.

The vapor portion stream 36 from expander inlet separator 34 is divided into two streams: main portion 42*a* and remaining portion 44*a*. The main portion 42*a*, about 71%, is expanded with an expansion ratio of about 2.17 through a work-expansion turbine 40 prior to entering the demethanizer 28 right below the overhead rectifying section as expander discharge 42. The remaining vapor portion 44*a* is cooled to substantial condensation, and in most cases subcooling, to approximately −146° F. via a reflux exchanger 26. This subcooled liquid stream 44 is expanded through expansion valve 100 to the top of demethanizer 28 as liquid reflux.

The demethanizer operated at approximately 340 psia is a conventional distillation column containing a plurality of mass contacting devices, trays or packings, or some combination of the above. It is typically equipped with one or more liquid draw trays in the lower section of the column to provide heat to the column for stripping volatile components off from the bottom liquid product. This is accomplished via the use of a side reboiler 80 and gas/liquid exchanger 120.

Within the demethanizer 28, ethane and heavier components are recovered in bottom liquid product stream 86 while leaving methane and lighter compounds in the top overhead vapor as residue gas stream 46. The residue gas stream 46 after being heated to near feed gas temperature in reflux exchanger 26, and gas/gas exchanger 24 is introduced into the suction of the expander compressor 52, where it is compressed to approximately 380psia by utilizing work extracted from turbine 40. The bottom liquid product stream 86 is pumped via pump 90 and delivered after providing refrigeration to the gas/liquid exchanger 120.

Figure 2:
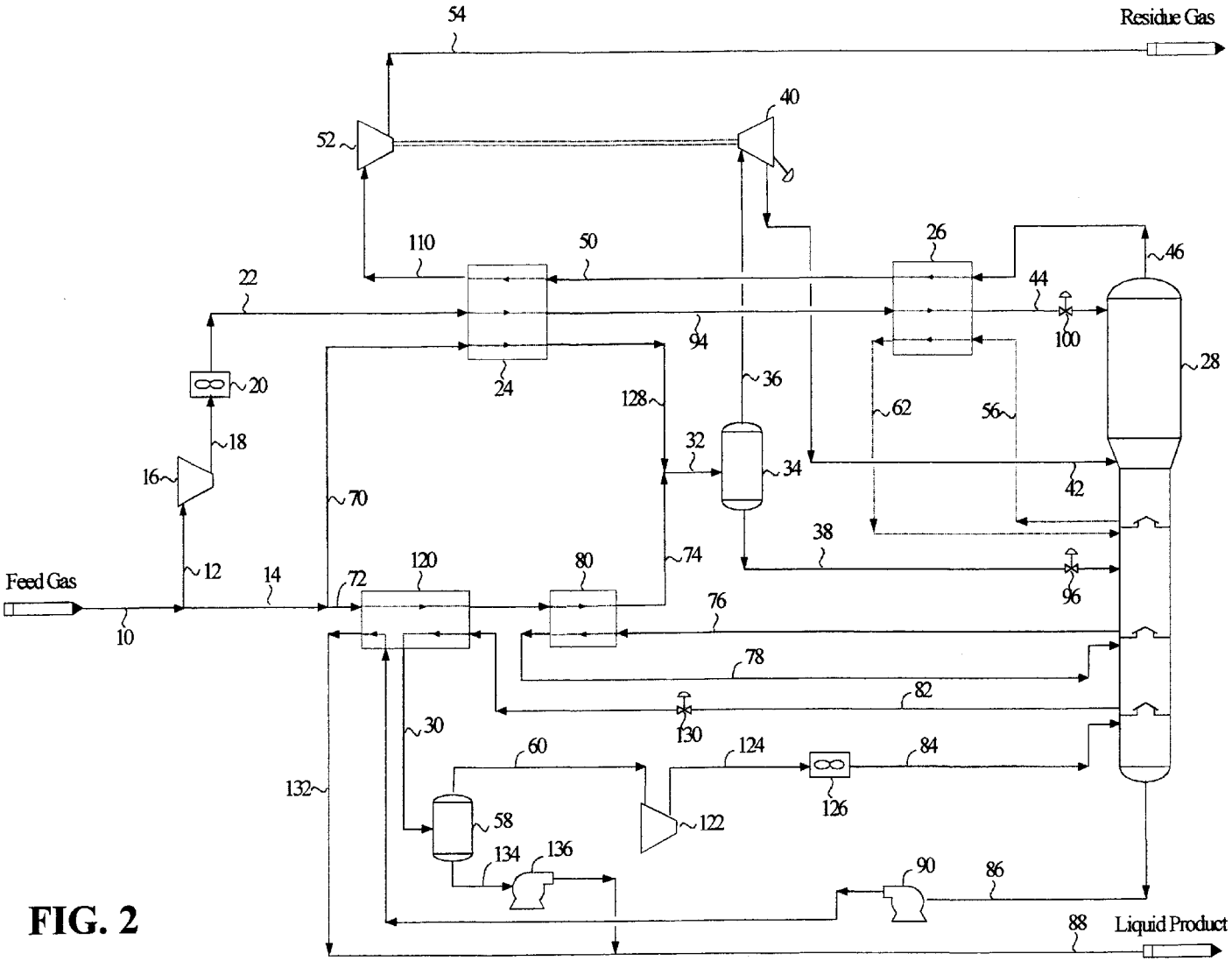
FIG. 2 is a schematic flow diagram of a cryogenic expansion process incorporating the improvement of the present idea.

The methods of the present invention will now be illustrated with reference to FIGS. 2, 3, 4, and 5. Shown in FIG. 2 is one embodiment of the hydrocarbon gas processing system of the invention, where the same reference numerals as used previously refer to similar streams and equipment. The following merely provides an exemplary description of the use of present invention in a conventional system for processing inlet gas and should not be considered as limiting the methods of the present invention.

Looking first at one non-limiting embodiment of the invention illustrated in FIG. 2, feed gas 10 which has been pretreated as necessary to remove any concentration of sulfur compounds, mercury, and water enters the cryogenic process at 600 psia and 100° F. This feed gas is split into two streams 12 and 14. Stream 14 forms the majority of the gas (62.3% in this example). Stream 14 is further split into streams, 70 and 72, which are cooled in gas/gas exchanger 24 and gas/liquid exchanger 120 respectively. The cooled gas from the gas/liquid exchanger 120 is directed to the side reboiler 80, where the gas is further cooled by side liquid draw 76 from the cryogenic distillation column 28, here a demethanizer. The heat picked up by the side streams partially supplies the reboiler duty for the demethanizer 28.

Stream 74 exits the side reboiler 80 at −33° F. and is combined with the cooled stream 128 from gas/gas exchanger 24. The resulting stream 32 enters the expander inlet separator 34 at approximately −33° F. and 590 psia for separation of the condensed liquid, if any, as stream 38. The liquid portion as stream 38 is delivered to the middle of the demethanizer 28 below the feed of expander discharge 42, after being flashed to the demethanizer pressure by the expansion valve 96.

The vapor stream 36 from the separator 34 passes through a work-expansion turbine 40 with an expansion ratio of approximately 1.67. Within the turbine 40, the vapor is expanded almost isentropically to a lower pressure of demethanizer 28 of about 350 psia, in a non-limiting example, resulting in work extraction and cooling the expanded stream to form a partially condensed stream 42 at about −76° F. The resulting two-phase stream 42 is then directed to the demethanizer 28 right below the top rectifying section. The mechanical work generated through the vapor expansion can be used to drive the expander compressor 52, which compresses the residue gas leaving gas/gas exchanger 24.

The remaining portion of the feed gas, stream 12, also known as a first gaseous stream or a slip stream, is first compressed to approximately 935 psia by the reflux compressor 16. The compressed gas stream 18 from the reflux compressor 16 is cooled in exchangers 20 and 24. The cooled compressed gas from gas/gas exchanger 24 is directed to the reflux exchanger 26 where it is completely condensed and subcooled to −143° F. This subcooled liquid 44 is expanded through the expansion valve 100 prior to being introduced as the main reflux for the top section of the demethanizer 28. The demethanizer 28 operated at approximately 350 psia is a conventional distillation column containing a plurality of mass contacting devices, trays or packing, or some combination of the above. It is typically equipped with one or more liquid draw trays in the lower section of the column to provide heat to the column for stripping volatile components off from the bottom liquid product. This is accomplished via the use of a side reboiler 80 and gas/liquid exchanger 120. The side draw liquid 76 enters the side reboiler 80 at −40° F., and exits as stream 78 at approximately −2° F., prior to returning to the demethanizer 28 to partially provide reboiler duty for the demethanizer 28.

The residue gas 46 exiting from the upper portion of the demethanizer 28 at 350 psia and −147° F. is fed to the reflux exchanger 26, providing refrigeration for condensing the compressed slip stream 94 of the feed gas (to be used as main reflux 44). The residue gas exits the reflux exchanger 26 as stream 50 at −42° F. It is further warmed to near the feed gas temperature via gas/gas exchanger 24. The warmed residue gas 110 leaving the gas/gas exchanger 24 at approximately 86° F. is sent to the suction of the expander compressor 52, where it is compressed to 380 psia by utilizing work extracted from the expander 40. Depending upon the delivery pressure, a residue gas compressor (not shown in FIG. 2) may be needed to further compress the residue gas stream 54 for final delivery.

Liquid collected in chimney tray near the feed of the expander discharge 42 may be optionally withdrawn as stream 56 and heated in the reflux exchanger 26, providing additional refrigeration for condensing the compressed slip stream 94 from the gas/gas exchanger 24. The heated stream 62 is then fed back into the demethanizer 28 at a location below where it is drawn and provides another part of the reboiler duty for the demethanizer 28.

In this non-limiting embodiment of the present invention, the refrigeration provided by the residue gas from the demethanizer 28 and the side liquid draws from the demethanizer 28 is not sufficient to achieve the target 90+% ethane recovery. Thus, additional refrigeration in the form of enhanced stripping gas scheme detailed below is used for this purpose.

Stream 82 is withdrawn from the chimney tray near the bottom of the demethanizer column 28, and is expanded through expansion valve 130 at 135 psia. The expanded stream is fed to the gas/liquid exchanger 120, providing refrigeration for cooling inlet gas stream 72. The heated stream 30 from the exchanger is then fed to the separator 58 for removal of any liquid components. The liquid stream 134 comprising less volatile NGL components is pumped and mixed with the bottom liquid 132 from the demethanizer 28 as the NGL product stream 88 via pump 136. The gas portion 60 from the separator 58 is compressed via stripping gas compressor 122, and is thereafter cooled to 110° F. in the air cooler 126 prior to being introduced back to the bottom of the demethanizer 28 as the stripping gas 84. This stripping gas scheme not only provides refrigeration for the inlet gas cooling and a portion of the reboiler duty of the demethanizer 28, but also enhances the separation efficiency within the demethanizer 28. The stripping gas comprising predominantly ethane and propane offers various advantages to the demethanizer 28, such as lowering the temperature profile in the lower section of the demethanizer 28 and increasing the relative volatility between methane and ethane.

Ethane and heavier components are recovered in the bottom liquid stream 86 while leaving methane and lighter compounds in the top overhead vapor as residue gas 46. The bottom liquid stream 86 from the demethanizer 28 is pumped and sent to the gas/liquid exchanger 120 to provide refrigeration for cooling a part of the inlet stream 72, and is then delivered to pipeline as the NGL product after combining with the liquid stream 134 at approximately 700 psia. In cases where it is not cold enough to provide cooling for the inlet stream 72, the bottom liquid stream 86, after being pumped, will be delivered as appropriate and will bypass the gas/liquid exchanger 120.

Table 1 and Table 2 present the performance of the above-mentioned embodiments illustrated in FIG. 1 and FIG. 2 respectively for a target ethane recovery above 90% from a feed flowrate of 100 MMSCFD. As indicated in Table 1, when compression on the entire feed gas stream is used in a typical comparative process, it is required to use an expansion ratio of 2.17 and a total compression horsepower of 1455 to achieve 91% ethane recovery. However, as indicated in Table 2 where the present invention is used, ethane recovery of 91% can be achieved with a lower expansion ratio of 1.67 and a total compression horsepower of 1190.

When the gas compression is used on only the split feed stream as required to provide the main reflux as described in this invention, the total required horsepower can be reduced by approximately 22% as compared to the prior art processes where compression of the whole stream is conventionally done. Thus by implementing this invention, the operational requirements can be decreased by avoiding compression of the whole feed stream to the cryogenic plant. For the comparative process, all process equipment upstream of the demethanizer 28 needs to have design pressure high enough for the compressed feed gas stream. In the inventive process, only equipment associated with split feed compression is required to have higher and more expensive design pressure. In addition, the constraints imposed by existing compressor drivers can often be overcome by implementing this invention in the retrofitting of pre-existing plants.

TABLE 1

Overall performance of comparative process illustrated in FIG. 1

| | Stream and component flows in lb-mole/hr | | | | | |
|---|---|---|---|---|---|---|
| Stream | Methane | Ethane | Propane | Butane+ | Nonhydrocarbons | Total |
| 10 | 10082.4 | 329.5 | 164.3 | 185.4 | 219.1 | 10980.7 |
| 46 | 10074.9 | 28.7 | 1.5 | 0.2 | 155.1 | 10260.4 |
| 88 | 7.5 | 300.8 | 162.8 | 185.2 | 64.0 | 720.3 |

Other performance details

| | |
|---|---|
| Expansion Ratio | 2.17 |
| Expander adiabatic efficiency assumed | 82% |
| % Ethane recovery | 91.3 |
| % Propane recovery | 99.1 |
| Feed gas compressor horsepower | 1455 bhp |
| Total compression horsepower | 1455 bhp |

TABLE 2

Overall performance of inventive process represented in FIG. 2

| | Stream and component flows in lb-mole/hr | | | | | |
|---|---|---|---|---|---|---|
| Stream | Methane | Ethane | Propane | Butane+ | Non-hydrocarbons | Total |
| 10 | 10082.4 | 329.5 | 164.3 | 185.4 | 219.1 | 10980.7 |
| 46 | 10075.0 | 29.5 | 2.1 | 0.4 | 151.5 | 10258.5 |
| 88 | 7.4 | 300.0 | 162.2 | 185.0 | 67.6 | 722.2 |

Other performance details

| | |
|---|---|
| Expansion Ratio | 1.67 |
| Expander adiabatic efficiency assumed | 82% |
| % Ethane recovery | 91.1 |
| % Propane recovery | 98.7 |
| Reflux compressor horsepower | 985 bhp |
| Stripping gas compressor horsepower | 205 bhp |
| Total compression horsepower | 1190 bhp |

Figure 3:
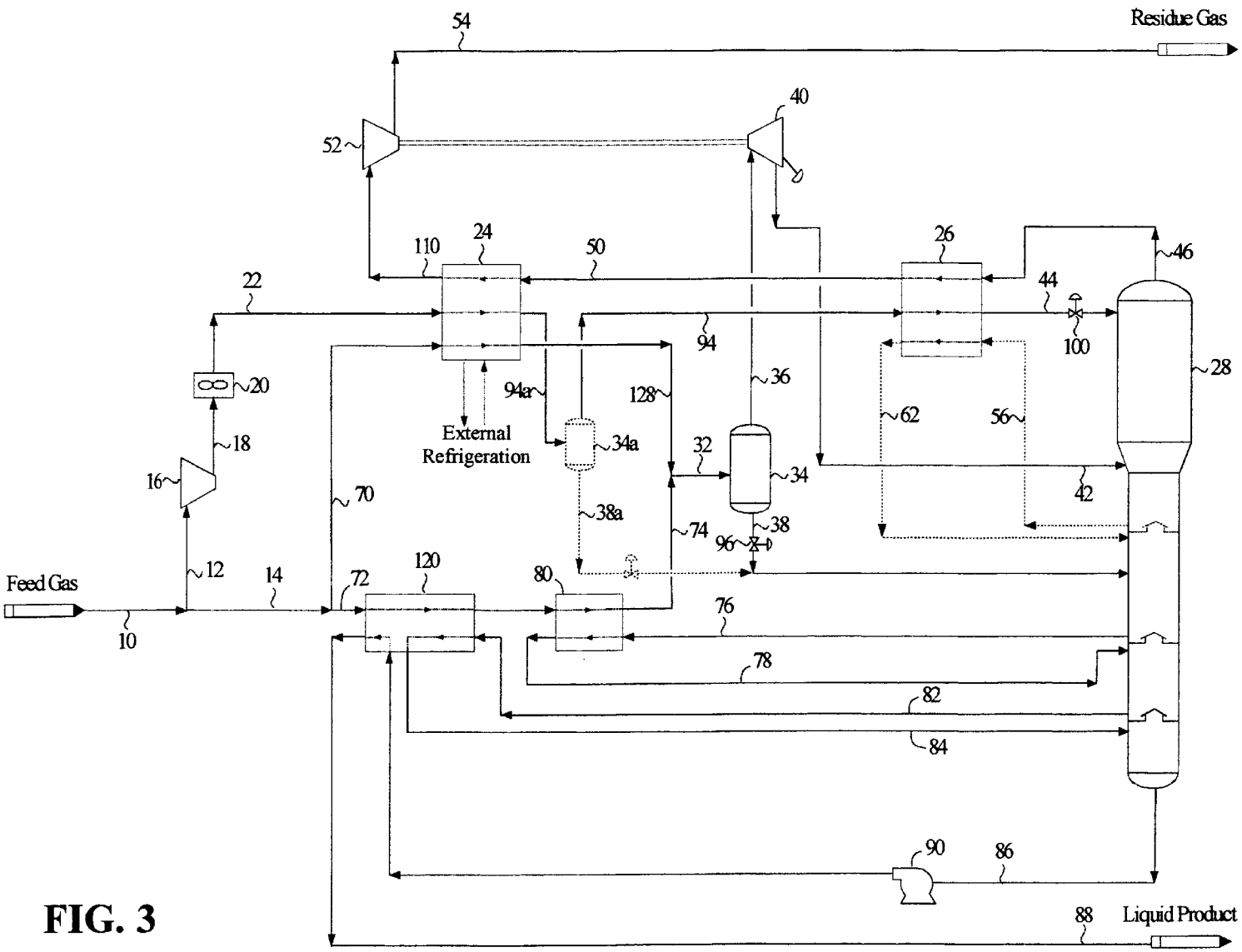
FIG. 3 is an alternate arrangement of a cryogenic expansion process incorporating an improvement of the present idea, where external refrigeration may be used.

In another embodiment of the present invention, external refrigeration such as propane can be employed alternately to replace the self-refrigeration derived from the enhanced stripping gas scheme. Thus the stripping gas compressor 122 in FIG. 2 and related equipment can be eliminated. FIG. 3 represents a schematic illustration of such an embodiment where same stream and equipment numbers are used for those having similar functionality as in FIG. 2. The system illustrated in FIG. 3 is essentially identical to that in FIG. 2 and operates in a similar manner accordingly, except for the differences detailed below. The example as shown in FIG. 3 and described below merely provides an exemplary description of the use of present invention in a conventional system for processing inlet gas and should not be considered as limiting the methods of the present invention.

With reference to FIG. 3, the cooled compressed feed stream 94*a* leaving the gas/gas exchanger 24, instead of being sent to the reflux exchanger 26 directly as in FIG. 2, enters a cold separator 34*a* for removal of condensed heavy components as stream 38*a*. The provision of the cold separator 34*a* is optional (shown as dashed line in FIG. 3) and is typically recommended when the feed gas contains heavier constituents, such as aromatic compounds, which could potentially freeze up in the reflux condenser at cryogenic temperatures. The liquid portion 38*a* separated from the cold separator 34*a* is fed to the middle of demethanizer 28 for further fractionation. The vapor portion 94 from the separator 34*a* is then directed to reflux exchanger 26 for condensation and utilized as the main reflux as previously described in FIG. 2.

Instead of being reduced in pressure across expansion valve 130 to generate self-refrigeration as detailed in FIG. 2, the liquid draw 82 from the lower portion of the demethanizer 28 enters the gas/liquid exchanger 120 in a typical bottom reboiler arrangement. The heated stream 84 returns to the bottom of the demethanizer 28, thereby providing bottom reboiler duty in a conventional way. Should additional refrigeration be needed, external refrigeration such as propane can be used in the front-end cooling arrangement as a supplement. The external refrigeration applied to the gas/gas exchanger 24 as depicted in FIG. 3 is merely for illustration purpose. Its location and application often dictated by the composition (richness) of the feed gas and target recovery level may be optimally varied as parts of overall energy integration.

For cases where higher ethane recovery is required, the main reflux provided by the split stream might not be sufficient. In those cases a leaner reflux stream (e.g., a compressed and condensed portion of the overhead product from the demethanizer 28 etc.) may be required for further rectification. The present invention can be applied for higher ethane recovery cases by using the split feed compression process to provide the main reflux for the demethanizer. The additional leaner reflux can be provided by any means or derived from the compressed slip stream 22 to generate the leaner reflux. Various means to generate a leaner reflux are mentioned in U.S. Pat. Nos. 4,851,020; 4,889,545; 4,687,499; 5,568,737; 4,519,824; 5,953,935; and others incorporated herein by reference. It must be reiterated though that the lean reflux is only required for further optimization.

Figure 4:
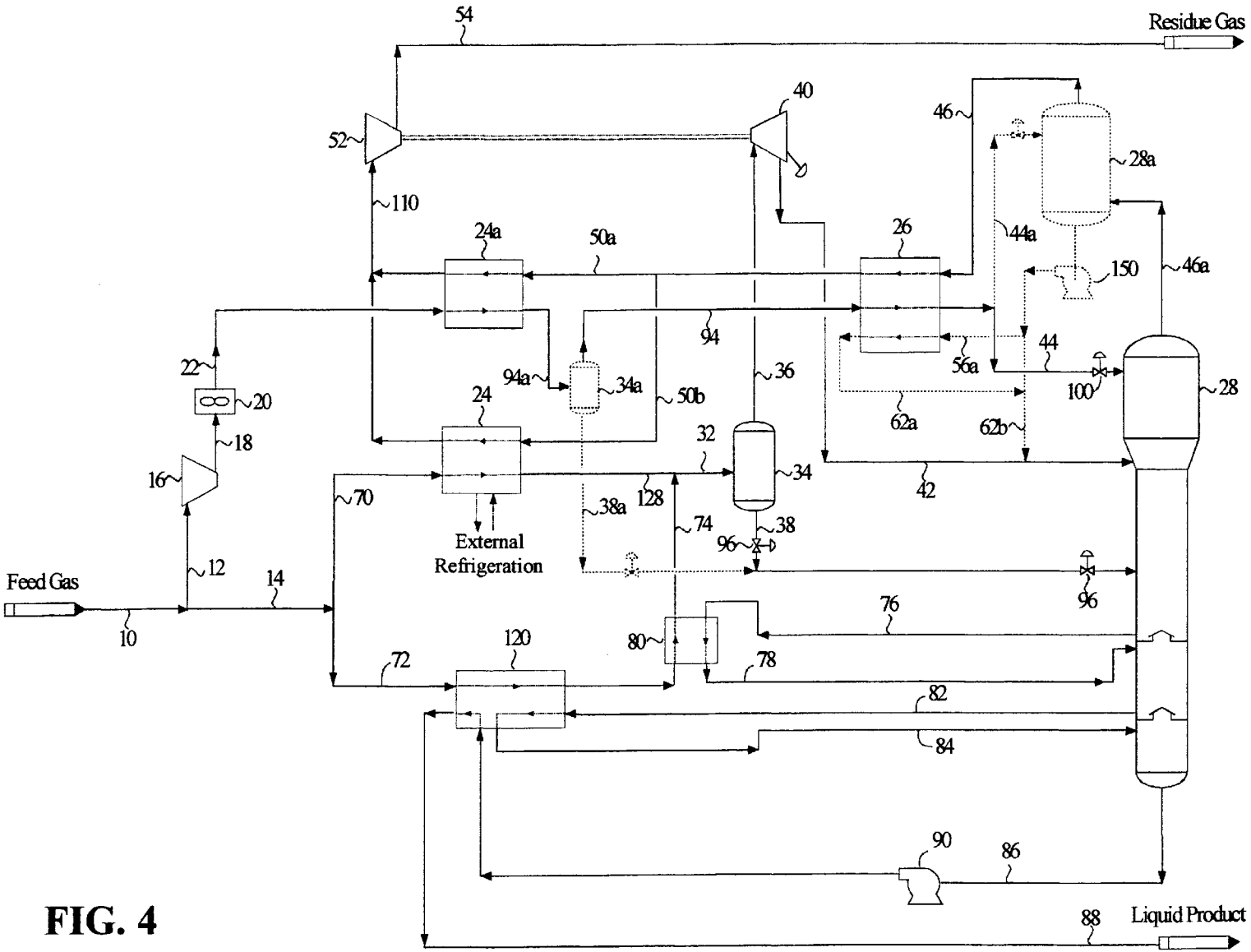
FIG. 4 is a simplified arrangement of a cryogenic expansion process incorporating an improvement of the present idea depicting application of the present invention for retrofitting existing facilities.

An alternative embodiment of the present invention can also be applied to debottleneck existing facilities and to achieve higher ethane recovery from existing facilities with minimal capital investment. FIG. 4 is an illustration of one such case. The embodiment shown in FIG. 4 is for retrofitting existing facilities. The embodiments shown in FIG. 3 and FIG. 4 have a few differences which are discussed below.

In some retrofitting cases it is possible that the existing demethanizer tower might not have sufficient trays, above the feed trays, to provide an adequate rectification section. In such cases an additional absorber, 28a (in FIG. 4) is required. The main reflux stream can then either be completely fed to the new absorber 28*a* or a portion of it, stream 44*a*, will be fed to the new tower and the rest of the reflux, stream 44, will be fed to the existing demethanizer tower, 28.

In case the additional absorber 28*a* is required, then the liquid from the bottom of the absorber 28*a* is pumped by pump 150 and is fed to the existing demethanizer, 28. In some cases additional refrigeration in the reflux exchanger 26 might be required. Since in retrofits the demethanizer 28 is pre-existing, it may not be possible to obtain any additional side draws for heat integration. In such cases the liquid from the new absorber 28*a* can be used to provide refrigeration in the reflux exchanger. In such cases the stream 56*a* of the bottom liquid from the new absorber, 28*a*, provides refrigeration in the reflux exchanger 26. Stream 62*a* from the reflux exchanger 26 is then fed as stream 62*b* to the demethanizer 28 after being combined with partially condensed stream 42.

As mentioned for the embodiment shown in FIG. 3, it is possible, in some cases, that the refrigeration provided by residue gas might not be enough to cool the inlet gas to a level required to obtain a desired recovery. In such cases external refrigeration may be used to cool the inlet gas. This external refrigeration can be used in gas/gas exchanger 24 (as shown in FIG. 4) or in any other exchanger. As mentioned above, the location and application of external refrigeration is often dictated by the composition (e.g., richness) of the feed gas and target recovery level and may be optimally varied as a part of overall energy integration.

The residue gas, stream 46, from the new absorber 28*a* is fed to the heat exchanger 26. In case the new absorber 28*a* is not required, the overhead product from the demethanizer 28 will be fed to the reflux exchanger 26, otherwise the overhead product, stream 46*a*, from the demethanizer 28 will be sent to the new absorber, 28*a*.

In another embodiment of the present invention the inlet gas cooling can be achieved in an inlet gas-cooling block 154 which can combine the inlet feed gas 14, the split vapor 22, the cold residue gas 50 and the side draws 76 and 82 from the demethanizer in various combinations to provide optimized heat integration. The differences in the embodiment shown in FIG. 5 and the embodiment shown in FIG. 3 are described below.

Figure 5:
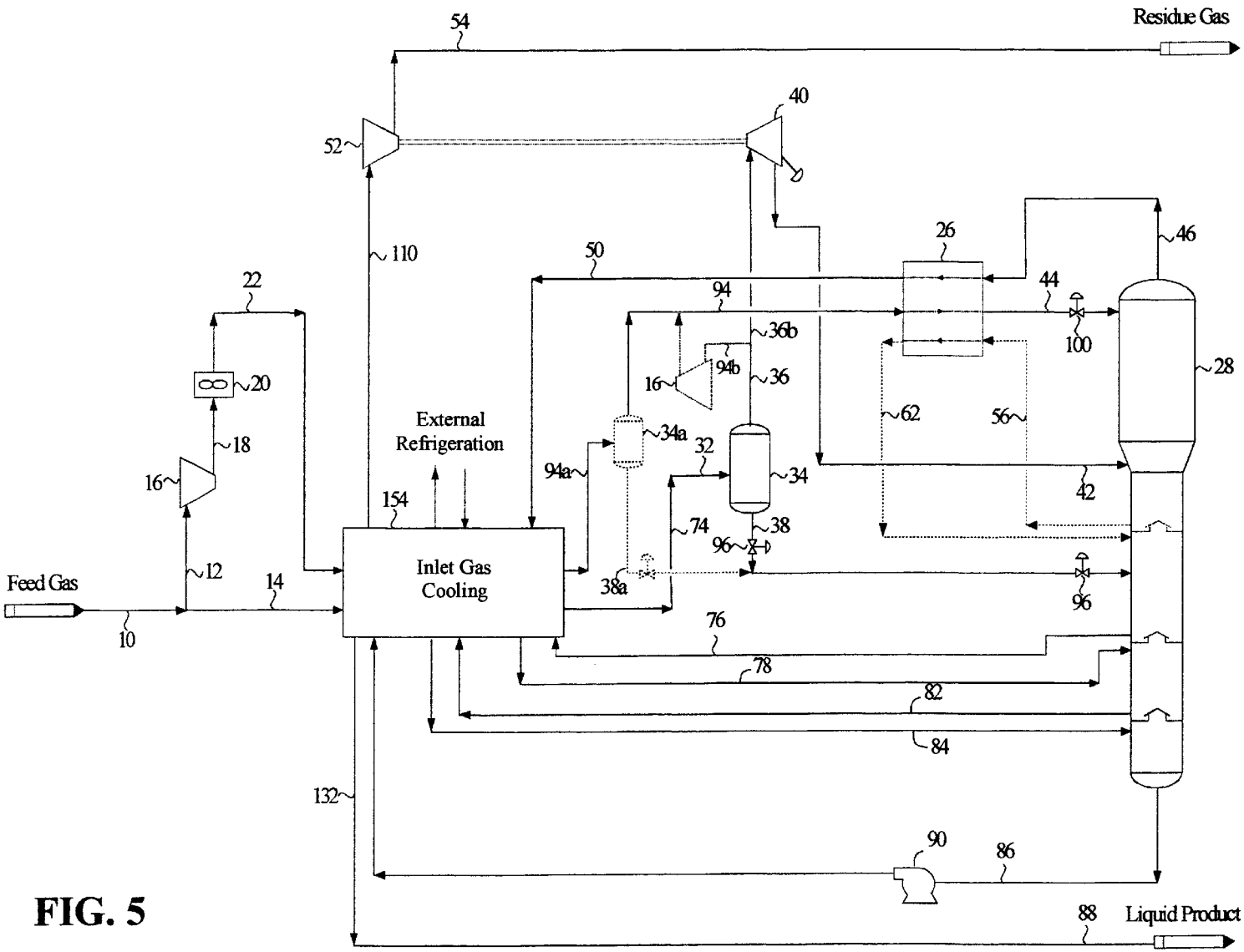
FIG. 5 is another simplified arrangement of a cryogenic expansion process incorporating an improvement of the present idea. This arrangement illustrates the inlet gas cooling by an exchanger block.

The embodiment shown in FIG. 5 replaces the inlet gas cooling exchangers 120, 80 and 24 of FIG. 3 by an inlet gas-cooling block 154. The inlet gas cooling block 154 represents one or a combination of exchangers. The feeds to the inlet gas cooling block can be distributed among these exchanger(s) in order to achieve the best heat integration while achieving the desired temperature levels for the product streams from the inlet cooling block 154. This inlet gas cooling block 154 serves to cool the split vapor stream 22 and the inlet gas stream 14 to the desired temperatures. Additionally, the inlet gas cooling block 154 provides a part of the reboiler duty to the demethanizer by using the side draws from the demethanizer (streams 76 and 82) to provide refrigeration. As mentioned above the inlet gas cooling block 154 can combine streams in various combinations to provide an effective heat integrated design to achieve the desired inlet gas and split vapor cooling. The function and arrangement of the expander inlet separator, 34, the cold separator, 34*a*, the reflux exchanger, 26, and other similar equipment is similar to the embodiment shown in FIG. 3.

There is an alternate embodiment of the present invention in which the gas to be used as the reflux is obtained by splitting the vapor from the expander inlet separator 34. This embodiment is similar to the embodiment described above except that the inlet gas stream 10 is not split into streams 12 and 14. The inlet gas 10 is cooled in the inlet gas cooling block 154 and the resulting stream 32 is then fed to the expander inlet separator 34. The vapor stream 36 from the separator 34 is split into streams 94*b* and 36*b*. Stream 36*b* is directed through the work-expansion turbine 40 and expanded to a lower pressure as previously described. Stream 94*b* is compressed by the reflux compressor 16 and is further condensed and subcooled in the reflux exchanger 26 and is fed to the demethanizer 28 as the main reflux 44. The rest of the process is similar to the embodiment described above. This alternative embodiment shows that although most of the above examples show the split stream of the feed gas being compressed by the reflux compressor for providing main reflux, the main reflux can also be provided by compressing the split stream from the vapor of expander inlet separator 34 or by compressing any vapor or any split stream of the vapor obtained by partial condensation and separation of the inlet feed.

In the foregoing specification, the invention has been described with reference to specific embodiments thereof, and has been demonstrated as effective in providing structures and processes for maximizing the recovery of ethane and heavier components from a stream containing those components and methane. However, it will be evident that various modifications and changes can be made thereto without departing from the broader spirit or scope of the invention. Accordingly, the specification is to be regarded in an illustrative rather than a restrictive sense. For example, there may be other ways of configuring and/or operating the hydrocarbon gas processing system of the invention differently from those explicitly described herein which nevertheless fall within the scope of the invention. It is anticipated that by routing certain streams differently, or by adjusting operating parameters certain optimizations and efficiencies may be obtained which would nevertheless not cause the system to fall outside of the scope of the present invention.

We claim:

1. A process for recovering relatively less volatile components from a gas mixture while rejecting relatively more volatile components as residue gas via a cryogenic distillation column wherein its reflux stream is generated by the steps comprising:

a) dividing a vapor portion of said gas mixture into a first gaseous stream and a main gaseous stream;

b) compressing said first gaseous stream and cooling it to produce a cooled, compressed first gaseous stream;

c) further handling cooled, compressed first gaseous stream as selected from the group consisting of i) feeding cooled, compressed first gaseous stream as a reflux stream directly to said cryogenic distillation column, and ii) further processing cooled, compressed first gaseous stream to generate at least one reflux stream for said cryogenic distillation column; and d) cooling said main gaseous stream and separating it into a first liquid phase comprising condensed components, if any, and into a first vapor phase; and thereafter introducing said first liquid phase and said first vapor phase into said cryogenic distillation column at one or more feed trays.

2. The process of claim 1 wherein at least a portion of the refrigeration for cooling said main gaseous stream or compressed first gaseous stream is provided by an external refrigeration system.

3. The process of claim 1 wherein at least part of said cooling is accomplished by a refrigeration stream withdrawn from said cryogenic distillation column; the cooling resulting in partial vaporization of said refrigerant stream.

4. The process of claim 3 further comprising separating said partially vaporized refrigerant stream into a second gas phase which is introduced into said cryogenic distillation column, and a second liquid phase.

5. A process for recovering relatively less volatile components from a gas mixture while rejecting relatively more volatile components as residue gas via a cryogenic distillation column wherein its reflux stream is generated by the steps comprising:

a) cooling said gas mixture and thereafter separating said cooled gas mixture into a first vapor stream and a condensed gas mixture stream, if any;

b) dividing said first vapor stream into a first gaseous stream and a main gaseous stream;

c) compressing said first gaseous stream and then cooling it to produce a cooled, compressed first gaseous stream; and d) further handling cooled, compressed first gaseous stream as selected from the group consisting of i) feeding cooled, compressed first gaseous stream as a reflux stream directly to said cryogenic distillation column, and ii) further processing cooled, compressed first gaseous stream to generate at least one reflux stream for said cryogenic distillation column.

6. The process of claim 5 wherein at least a portion of the refrigeration for cooling said gas mixture or compressed first gaseous stream is provided by an external refrigeration system.

7. The process of claim 5 wherein at least part of said cooling is accomplished by a refrigeration stream withdrawn from said cryogenic distillation column; the cooling resulting in partial vaporization of said refrigerant stream.

8. The process of claim 7 further comprising separating said partially vaporized refrigerant stream into a second gas phase which is introduced into said cryogenic distillation column, and a second liquid phase.

9. The process of claim 5 wherein no condensed gas mixture stream is obtained during said cooling step a) and no separation of said cooled gas mixture occurs.

10. The process of claim 9 wherein at least a portion of the refrigeration for cooling said gas mixture or compressed first gaseous stream is provided by an external refrigeration system.

11. The process of claim 9 wherein at least part of said cooling is accomplished by a refrigeration stream withdrawn from said cryogenic distillation column; the cooling resulting in partial vaporization of said refrigerant stream.

12. The process of claim 11 further comprising separating said partially vaporized refrigerant stream into a second gas phase which is introduced into said cryogenic distillation column, and a second liquid phase.

13. The process of claim 5 further comprising introducing said main gaseous stream and condensed feed gas stream into said cryogenic distillation column at one or more feed trays.

14. In an apparatus for recovering relatively less volatile components from a gas mixture while rejecting relatively more volatile components as residue gas via a cryogenic distillation column, the apparatus comprising:

a) means for dividing a vapor portion of said gas mixture into a first gaseous stream and a main gaseous stream;

b) a compressor for increasing the pressure of said first gaseous stream;

c) means for cooling and at least partially condensing said compressed first gaseous stream;

d) a cryogenic distillation column having a plurality of feed trays and recovery stages, which receives said cooled, compressed, at least partially condensed first gaseous stream as reflux stream to enhance recovery of relatively less volatile components;

e) means for cooling said main gaseous stream;

f) a separator for separating said cooled main gaseous stream into a first liquid phase comprising condensed components, if any, and into a first vapor phase; and g) means for introducing said first liquid phase and said first vapor phase into said cryogenic distillation column at one or more feed trays;

where the c) means for cooling and condensing said compressed first gaseous stream may be the same or different as e).

15. The apparatus of claim 14 further comprising a device to further process said cooled, compressed first gaseous stream to generate at least one reflux stream for said cryogenic distillation column.

16. The apparatus of claim 14 further comprising means for cooling said gas mixture prior to a) means for dividing said vapor portion of said gas mixture.

17. In an apparatus for recovering relatively less volatile components from a gas mixture while rejecting relatively more volatile components as residue gas via a cryogenic distillation column, the apparatus comprising:

a) means for cooling said gas mixture;

b) a separator for separating said cooled gas mixture into a first vapor stream and a condensed gas mixture stream, if any;

c) means for dividing said first vapor stream into a first gaseous stream and a main gaseous stream;

d) a compressor for increasing the pressure of said first gaseous stream;

e) means for cooling and at least partially condensing said compressed first gaseous stream; and f) a cryogenic distillation column having a plurality of feed trays and recovery stages, which receives said cooled, compressed, partially condensed first gaseous stream as reflux stream to enhance recovery of relatively less volatile components.

18. The apparatus of claim 17 further comprising a device to further process said cooled, compressed first gaseous stream to generate at least one reflux stream for said cryogenic distillation column.

* * * * *